US008965668B2

(12) United States Patent
Debelak et al.

(10) Patent No.: US 8,965,668 B2
(45) Date of Patent: Feb. 24, 2015

(54) MASTER/SLAVE ARRANGEMENT OF AN ELECTRONIC ENGINE CONTROL DEVICE WITH ENGINE IDENTIFICATION MODULE

(75) Inventors: Albrecht Debelak, Friedrichshafen (DE); Andreas Schneider, Meckenbeuren (DE); Michael Wölki, Immenstaad (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 261 days.

(21) Appl. No.: 13/461,991

(22) Filed: May 2, 2012

(65) Prior Publication Data

US 2012/0283938 A1 Nov. 8, 2012

(30) Foreign Application Priority Data

May 2, 2011 (DE) ..... 10 2011 100 188

(51) Int. Cl.
*F02D 41/24* (2006.01)
*F02D 41/28* (2006.01)

(52) U.S. Cl.
CPC ..... *F02D 41/24* (2013.01); *F02D 41/28* (2013.01); *F02D 41/2435* (2013.01)
USPC ..... 701/115; 123/486

(58) Field of Classification Search
USPC ..... 701/115, 113, 114, 29.6; 123/480, 486, 123/478, 145 A, 145 C; 711/100–103; 340/572.1
See application file for complete search history.

(56) References Cited

U.S. PATENT DOCUMENTS

| | | | | |
|---|---|---|---|---|
| 5,313,388 | A * | 5/1994 | Cortis | 701/29.6 |
| 6,695,473 | B2 * | 2/2004 | Unger et al. | 374/145 |
| 6,822,560 | B2 * | 11/2004 | Geber et al. | 340/439 |
| 6,898,489 | B1 * | 5/2005 | Hayes, Sr. | 701/1 |
| 8,036,819 | B2 | 10/2011 | Bleil et al. | |
| 2003/0223473 | A1 * | 12/2003 | Unger et al. | 374/141 |
| 2005/0253726 | A1 * | 11/2005 | Yoshida et al. | 340/572.8 |
| 2007/0018830 | A1 * | 1/2007 | Inoue et al. | 340/572.4 |
| 2012/0283964 | A1 | 11/2012 | Berks et al. | |

FOREIGN PATENT DOCUMENTS

| | | |
|---|---|---|
| DE | 10338649 | 3/2005 |
| DE | 10352033 | 6/2005 |
| EP | 1150190 | 8/2003 |
| EP | 1529956 | 5/2005 |
| EP | 1826386 | 8/2007 |

* cited by examiner

*Primary Examiner* — Mahmoud Gimie
(74) *Attorney, Agent, or Firm* — Lucas & Mercanti, LLP; Klaus P. Stoffel

(57) ABSTRACT

A master/slave arrangement of an electronic engine control device with an engine identification module. The electronic engine control device controls and regulates the internal combustion machine. The engine identification module includes at least one microprocessor and a memory building block for storing an engine identification as well as engine specifics. The electronic engine control device and the engine identification module exchange data through an engine cable harness. The engine identification module is arranged inseparably at the crank housing of the internal combustion machine. The engine identification module can be removed from the crank housing as well as from the engine cable harness only by being destroyed.

10 Claims, 1 Drawing Sheet

MASTER/SLAVE ARRANGEMENT OF AN ELECTRONIC ENGINE CONTROL DEVICE WITH ENGINE IDENTIFICATION MODULE

CROSS-REFERENCE TO RELATED APPLICATIONS

The present application claims priority of DE 10 2011 100 188.7, filed May 2, 2011, the priority of this application is hereby claimed and this application is incorporated herein by reference.

BACKGROUND OF THE INVENTION

The invention relates to a master/slave arrangement of an electronic engine control device with an engine identification module and a respectively adapted method.

From DE 103 52 033 A1, a master/slave arrangement is known in which the interaction of the electric components is optimized by the electronic engine control device as the master which scans the respective component, i.e., the slave, with respect to its characteristic data relevant for the operation. In this case, the characteristic data of the component is scanned in the initial phase from the permanent memory of the component and is transmitted to the electronic engine control device. If necessary, the control parameters of the electronic engine control device are then adjusted. Safety measures against interference by a third party are not described.

EP 1 826 386 A1 describes a master/slave arrangement for a diesel engine with common rail system. In this arrangement, the electronic engine control device corresponds to the master. The engine specifics are stored, among others, in the slave in a read only memory. Engine specifics are the deviations of an engine of a standard engine, for example, the properties which apply to the injector. As a supplement, identification data is stored in the read only memory of the slave. Protective measures against interference by a third party are also not illustrated.

SUMMARY OF THE INVENTION

It is the object of the invention to provide appropriate protective measures against interference by a third party in a master/slave arrangement.

In the master/slave arrangement of an electronic engine control device with an engine identification module, according to the invention, the engine identification module is inseparably arranged on the crank housing of the internal combustion engine in such a way that the engine identification module can only be separated by destroying the crank housing and the engine cable harness. This inseparability of engine identification module and crank housing is achieved by a dovetail connection or a locking connection. Since the electronic engine control device and the engine identification module are connected to each other through the engine cable harness, the plug on the side of the engine identification module is cast therewith. In addition, the data transmission from/to the engine control device takes place in an encoded form.

In addition to a high safety level against interference by a third party, for example, chip tuning, the invention is distinguished by its simplicity, which is reflected in a low price per unit.

In the method according to the invention, during the initializing phase of the electronic engine control device, the engine identification is read from the engine identification module and, in the case of a positive concordance, normal operation is released. A positive concordance exists if the electronic engine control device fits with the engine type. On the other hand, in the case of a negative concordance, the starting procedure is locked. It is also conceivable to allow a certain number of starting attempts or a time limit. This testing procedure is also carried out after an exchange of the electronic engine control device or after an exchange of the internal combustion engine.

An embodiment provides that during the operation of the internal combustion engine, the electronic engine control device actualizes the operating data in the engine identification module. Operation data refers to the engine operating hours and the wear of the injectors. Also, the engine identification module may constitute redundant data memory for the electronic engine control device in which the data values learned are stored.

The various features of novelty which characterize the invention are pointed out with particularity in the claims annexed to and forming a part of the disclosure. For a better understanding of the invention, its operating advantages, specific objects attained by its use, reference should be had to descriptive matter in which there are described preferred embodiments of the invention.

DETAILED DESCRIPTION OF THE INVENTION

Figure 1:
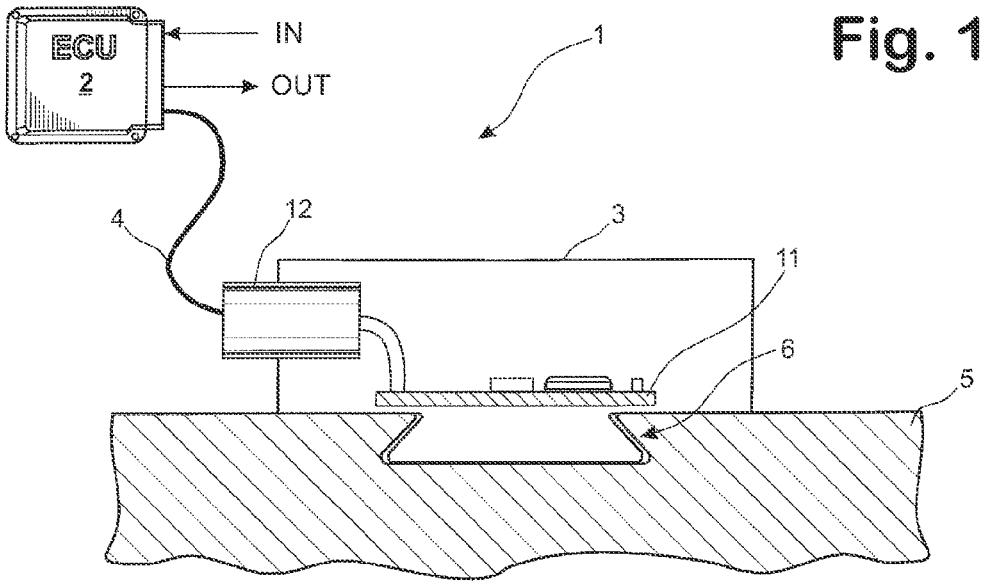
FIG. 1 shows a first embodiment of the master/slave arrangement.

FIG. 1 shows the master/slave arrangement 1 in a first embodiment in which the electronic engine control device 2 forms the master and the engine identification module 3 forms the slave. The mode of operation of the internal combustion engine is determined through the electronic control device 2. The electronic engine control device 2 includes the conventional components of a microcomputer system, for example, a microprocessor, I/O building blocks, buffers and memory building blocks (EEPROM, RAM). In the memory building blocks the operation data relevant for the operation of the internal combustion engine are applied in characteristic fields/characteristic lines. Through these, the electronic control device 2 computes the output values from the input values. The reference characters IN refer to the input values of a common rail system, for example, the rail pressure and an engine rate of rotation nMOT. The reference characters OUT denote the output values, for example, the control signal for a suction throttle and a control signal for the injectors device 2 and the engine identification module 3 are connected through an engine cable harness 4. The data transmission takes place in an encoded form, so that copying of the data transmission at the engine cable harness will not be successful. In the engine identification module 3, at least one microprocessor and a memory building block, for example, $E^2$PROM, are arranged for storing engine identification and engine specifics. Engine identification is understood to be the engine type, reference number and the serial number. Engine specifics are the individual properties of the internal combustion engine, which are determined on an acceptance test bench, for example, the individual properties of the injectors used. The data is stored in the memory building block after the test bench when carrying out the line end alignment. In addition, in the memory building block of the engine identification module, characteristic values (characteristic lines/characteristic fields) may be stored which are relevant with respect to exhaust gas laws, for example, the state of loading of a catalyst or the injector wear.

The engine identification module 3 is fastened on the crank housing 5 of the internal combustion engine through a dovetail connection 6. After the first installation of the engine identification module 3 on the crank housing 5, the engine identification module 3 cannot be removed from the crank housing 5 without destruction. Another safety measure resides in casting the plug 12 with the engine identification module 3.

Figure 2:
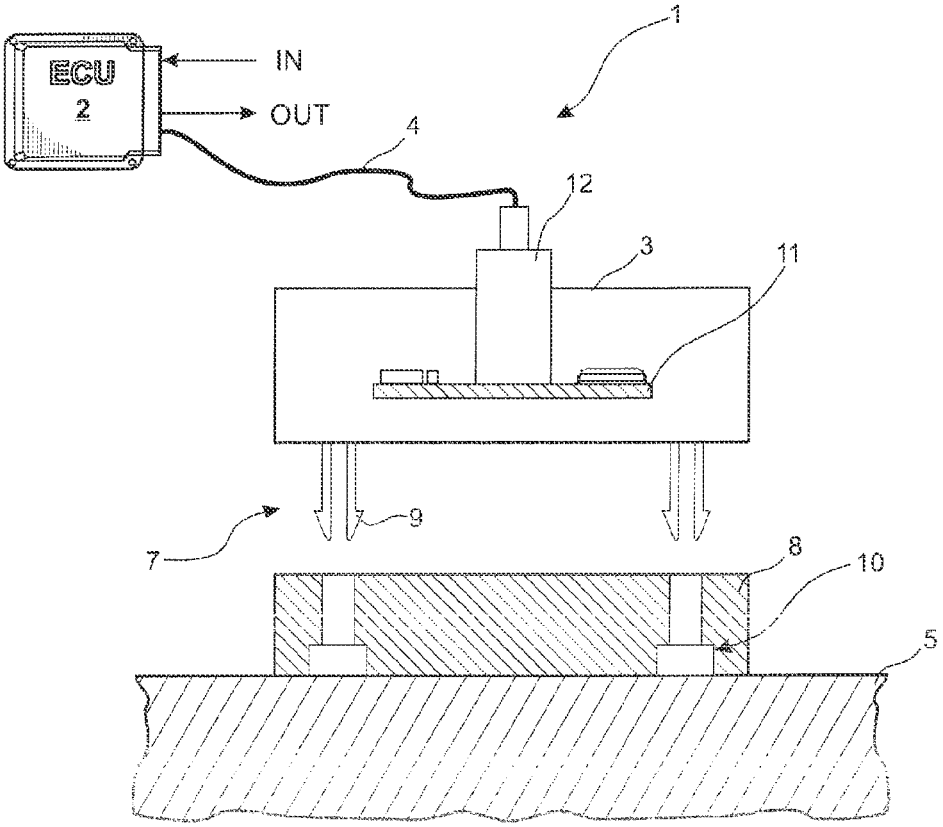
FIG. 2 shows a second embodiment of the master/slave arrangement.

FIG. 2 shows the master/slave arrangement 1 in a second embodiment. In this embodiment, the identification module 3 is fixed through a locking connection 7 directly to the crank housing 5, or as illustrated, through an intermediate plate 8 to the crank housing 5. The locking connection 7 engages over locking projections 9 in a stepped cylindrical recess 10. Also in this embodiment, the engine identification module 3 can no longer be removed without destruction after the first installation. An additional measure resides in that a conductor path of the plate 11 extends along the locking connection 7. In the case of a manipulation attempt in seeking an unauthorized removal, this conductor track is then interrupted, so that the engine identification module 3 is functionally destroyed.

During the initializing phase, the electronic engine control device 2 reads and counter checks the engine identification from the engine identification module 3. In the case of a positive concordance, i.e., the electronic engine control device 2 and t e engine identification form a correct master/slave arrangement for this internal combustion machine, normal operation is permitted. In the case of a negative concordance, on the other hand, the starting procedure is locked. It is also conceivable to set a specified number of starting attempts or a time limit. For example, if after a defect the electronic engine control device is replaced by a new one, the method ensures the correct pairing of engine control device/internal combustion machine. The same considerations apply also in the case where the internal combustion machine is replaced. In the case of an engine replacement, the skilled personnel of the engine manufacturer adjust the engine identification module 3 via electronic engine control device 2. This also makes an unauthorized use more difficult.

After the electronic engine control device 2 has determined a positive concordance, the engine specifics are read from the engine identification module 3. The engine specifics are then used in the electronic engine control device 2 for adapting the adjustment values, for example, for equalizing the cylinders by adjusting the injection beginning which is specific to the injector.

While specific embodiments of the invention have been shown and described in detail to illustrate the inventive principles, it will be understood that the inventions may be embodied otherwise without departing from such principle.

We claim:

1. A master/slave arrangement, comprising: an electronic engine control device; and an engine identification module, wherein the electronic engine control device controls and regulates an internal combustion engine, wherein the engine identification module contains at least one microprocessor and a memory building block for storing an engine identification and engine specifics, and wherein the electronic engine control device and the engine identification module exchange data through an engine cable harness, the engine identification module being inseparably connected to a crank housing of the internal combustion engine so that the engine identification module is separable from the crank housing and from the engine cable harness only by being destroyed, wherein a plug of the engine cable harness is cast with the engine identification module.

2. The master/slave arrangement according to claim 1, wherein the engine identification module includes a safety device for encoding data transmission through the engine cable harness from/to the engine control device.

3. The master/slave arrangement according to claim 2, wherein the engine identification module and the crank housing are in engagement with each other through a dovetail connection.

4. The master/slave arrangement according to claim 2, wherein the engine identification module is connected to the crank housing through a locking connection.

5. The master/slave arrangement according to claim 1, further comprising a memory building block in which engine characteristic data is additionally stored which is relevant with respect to exhaust gas laws.

6. A method for controlling and regulating an internal combustion machine with a master/slave arrangement, comprising the steps of:

providing an engine identification module cast with a plug of an engine cable harness; insepraraby connecting the engine identification module to a crank housing of the internal combustion engine so that the engine identification module is separable from the crank housing and from the cable harness only by being destroyed; during an initializing phase, reading the engine identification from the engine identification module with an electronic engine control device via the cable harness; and permitting normal operation in case of a positive concordance, and locking the starting procedure in case of a negative concordance.

7. The method according to claim 6, including, after an exchange of the electronic engine control device or after an exchange of the internal combustion machine, during the initializing phase, reading the engine identification from the engine identification module with the electronic engine control device, wherein, in the case of a positive concordance normal operation is permitted, and in the case of a negative concordance the starting procedure is locked.

8. The method according to claim 6, including determining engine specifics during a first run of the internal combustion machine on a test bench, storing the engine specifics in the engine identification module during a line end alignment, reading the engine specifics in the initializing phase by the electronic engine control device, and correcting adjusting values of the electronic engine control device based on the engine specifics.

9. The method according to claim 6, including, during the operation of the internal combustion machine, actualizing the operating data in the engine identification module using the electronic engine control device.

10. Method according to claim 9, including storing the data of the electronic engine control device redundantly in the engine identification module.

* * * * *